US005952139A

United States Patent [19]

Takeuchi et al.

[11] Patent Number: 5,952,139

[45] Date of Patent: Sep. 14, 1999

[54] ELECTROPHOTOGRAPHIC PHOTOCONDUCTOR

[75] Inventors: Masaru Takeuchi; Kenichi Ohkura, both of Nagano, Japan

[73] Assignee: Fuji Electric Co., Ltd., Japan

[21] Appl. No.: 09/024,898

[22] Filed: Feb. 17, 1998

[30] Foreign Application Priority Data

Feb. 14, 1997 [JP] Japan ..... 9-030076

[51] Int. Cl.[6] ..... G03G 5/04; G03G 5/147

[52] U.S. Cl. ..... 430/59; 430/56; 430/66; 430/67; 430/58

[58] Field of Search ..... 430/56, 58, 66, 430/67, 59

[56] References Cited

U.S. PATENT DOCUMENTS 5,606,400 2/1997 Nagayasu et al. ..... 399/168

FOREIGN PATENT DOCUMENTS 58-160957 9/1983 Japan .

*Primary Examiner*—Roland Martin
*Attorney, Agent, or Firm*—Rossi & Associates

[57] ABSTRACT

An electrophotographic photoconductor is provided which principally consists of an electrically conductive substrate, a charge generation layer, and a charge transport layer which contains an orange dye compound. Preferably, the orange dye compound is selected from the group consisting of 1-o-tolylazo-2-naphthol, 5-(9-anthracenyl methylene) amino-3-methyl-1-tolylpyrazole, 4,5-diiodo-3,6-fluoranediol, and 4,5-dibromo-3,6-fluoranediol.

3 Claims, 2 Drawing Sheets

ELECTROPHOTOGRAPHIC PHOTOCONDUCTOR

FIELD OF THE INVENTION

The present invention relates to electrophotographic photoconductors used in electrophotographic apparatus, such as printers and copying machines, and in particular to such photoconductors that do not suffer from fatigue due to exposure to light.

BACKGROUND OF THE INVENTION

As photosensitive materials of known electrophotographic photoconductors (also called "photoconductors"), there have been used inorganic photoconductive substances, such as selenium and selenium alloys, inorganic photoconductive substances, such as zinc oxide and cadmium sulfide, dispersed in a resin binder, organic photoconductive substances, such as poly-N-vinylcarbazole and polyvinyl anthracene, and organic photoconductive substances, such as a phthalocyanine compound and bisazo compound, dispersed in a resin binder or subjected to vacuum deposition, for example.

The electrophotographic photoconductors are required to have functions of maintaining a surface charge in the dark, generating charges upon receipt of light, and transporting the charges upon receipt of light. The known electrophotographic photoconductors include so-called single-layer type photoconductors having these functions in a single layer, and so-called function-separated laminated-layer type photoconductors each having a first layer that mainly serves to generate charges upon receipt of light, and a second layer that serves to maintain the surface charge in the dark and transport charges upon receipt of light.

The above types of electrophotographic conductors are used to form images by known electrophotographic methods, such as the Carlson method. The image formation by this method may be performed by charging the photoconductor in the dark by a corona discharge, forming a desired electrostatic latent image, such as characters or drawing of an original, on the charged surface of the photoconductor, developing the thus formed electrostatic latent image by means of toner particles, transferring and fixing the toner particles representing the desired image onto a support, such as paper. After the toner transfer, remaining toner particles are removed by cleaning, and any residual electrostatic charges are removed by erase exposures, so that the photoconductor can be used again.

In recent years, electrophotographic photoconductors using an organic substance have been put to practical use, in view of its advantageous characteristics, such as flexibility, thermal stability and film-forming capability. For example, a photoconductor formed of poly-N-vinylcarbazole and 2,4,7-trifluorene-9-one (as disclosed in U.S. Pat. No. 3,484,237), photoconductor containing an organic pigment as a major component (as disclosed in laid-open Japanese Patent Publication No. 47-37543), and a photoconductor containing as a major component an eutectic complex of a dye and a resin (as disclosed in laid-open Japanese Patent Publication No. 47-10785) have been proposed.

In the meantime, the function-separated laminated-layer type photoconductor that consists of a charge generation layer containing a charge generating substance and a charge transport layer containing a charge transport substance has been widely used in these days. In particular, numerous negative charge type photoconductors have been proposed wherein the charge generation layer is formed by vapor-depositing an organic pigment as a charge generating substance on a layer, or dispersing an organic pigment in a resin, and the charge transport layer is formed by dispersing an organic, low molecular weight compound as a charge transport substance in a resin.

Although organic substances have many advantageous properties that are not possessed by inorganic substances, such organic substances that satisfy all of characteristics electrophotographic photoconductors are required to exhibit have not been available. Namely, the photoconductor using the organic substance suffers from deterioration of the quality of images due to reduction in the potential of its charged surface after repeated use, increase in the remaining potential, and changes in the sensitivity, for example. Although not all of the causes for the deterioration have not been revealed, decomposition of the charge transport substance due repeated exposure to image light, light of erase exposure lamp, exposure to external light during maintenance, may be considered as some of the causes. It has been therefore proposed to add a dye or ultraviolet-ray absorbent to a surface protective layer or photosensitive layer so as to prevent deterioration due to these lights. For example, a dye or ultraviolet-ray absorbent having a light absorption characteristic that covers an absorbing wavelength range of the charge transport layer may be added to the surface protective layer, as disclosed in laid-open Japanese Patent Publication No. 58-160957, or a yellow dye may be added into the charge transport layer, as disclosed in laid-open Japanese Patent Publication No. 58-163946. With these known techniques, however, satisfactory effects have not been achieved, and the addition of such a dye or ultraviolet-ray absorbent may result in other problems, such as reduction in the sensitivity or an increase in the residual potential.

SUMMARY OF THE INVENTION

It is therefore an object of the present invention to provide an electrophotographic photoconductor that uses a new dye compound, thereby to be free from fatigue due to exposure to light, assuring high sensitivity and reduced residual potential.

The above object may be accomplished according to the first aspect of the present invention, which provides an electrophotographic photoconductor which principally consists of an electrically conductive substrate, charge transport layer, and a charge generation layer, wherein the charge transport layer contains an orange dye compound.

The same object may be accomplished according to the second aspect of the invention, which provides an electrophotographic photoconductor which principally consists of an electrically conductive substrate and a photosensitive layer, wherein the photosensitive layer contains an orange dye compound.

The same object may be accomplished according to the third aspect of the invention, which provides an electrophotographic photoconductor which principally consists of an electrically conductive substrate, photosensitive layer, and a surface protective layer, wherein the surface protective layer contains an orange dye compound.

In the electrophotographic photoconductors according to the first to third aspects of the invention, the orange dye compound is preferably selected from the group consisting of 1-o-tolylazo-2-naphthol, 5-(9-anthracenyl methylene) amino-3-methyl-1-tolylpyrazole, 4,5-diiodo-3,6-fluoranediol, and 4,5-dibromo-3,6-fluoranediol.

Blue light through ultraviolet light have strong chemical activities, and tend to decompose charge transport substances. If the photosensitive layer or surface protective layer contains the orange dye compound as indicated above, the orange dye compound absorbs or blocks blue light through ultraviolet light having strong chemical activities, without affecting electrophotographic characteristics, such as sensitivity or residual potential.

BRIEF DESCRIPTION OF THE DRAWINGS

The invention will be described in greater detail with reference to certain preferred embodiments thereof and the accompanying drawings, wherein.

DETAILED DESCRIPTION OF THE PREFERRED EMBODIMENTS

Figure 1:
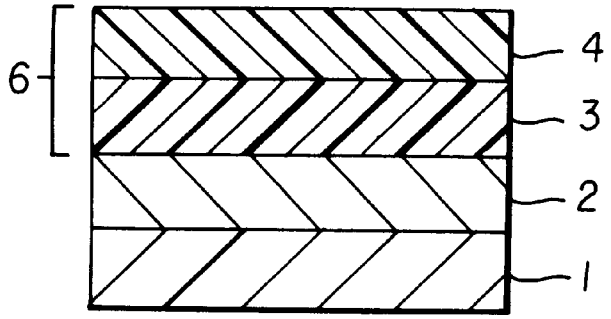
FIG. 1 is a cross sectional view showing a negative charge, function-separated type electrophotographic photoconductor as one embodiment of the present invention.
Figure 2:
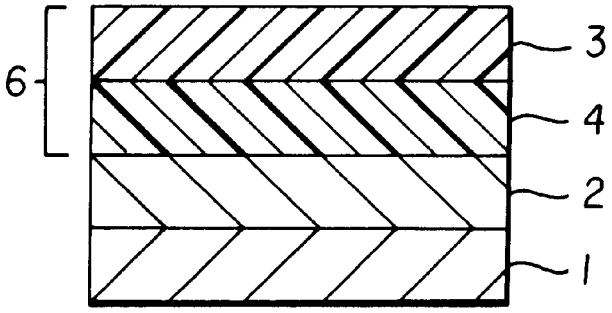
FIG. 2 is a cross sectional view showing a positive charge, function-separated type electrophotographic photoconductor as another embodiment of the invention.
Figure 3:
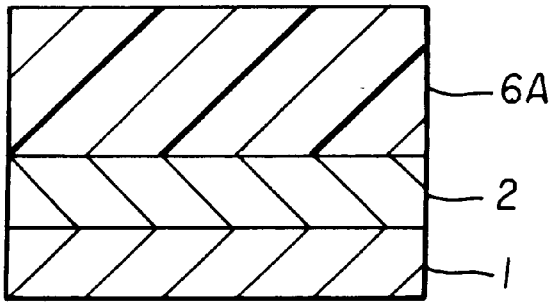
FIG. 3 is a cross sectional view showing a positive charge, single-layer type electrophotographic photoconductor as a further embodiment of the invention.
Figure 4:
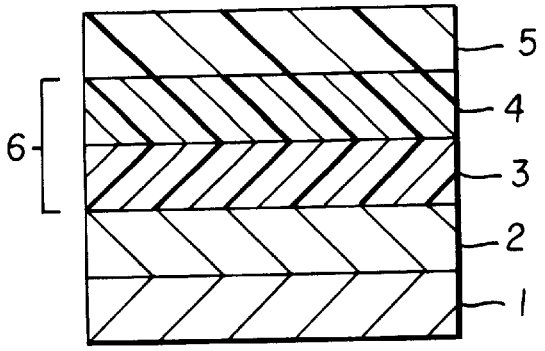
FIG. 4 is a cross sectional view showing a negative charge, function-separated type electrophotographic photoconductor as a still further embodiment of the invention.
Figure 5:
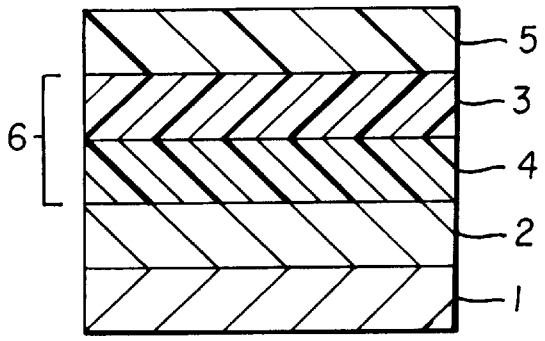
FIG. 5 is a cross sectional view showing a positive charge, function-separated type electrophotographic photoconductor as another embodiment of the invention.
Figure 6:
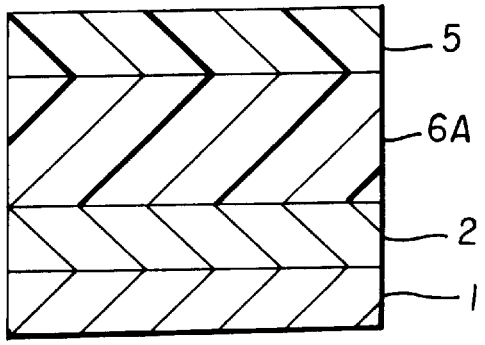
FIG. 6 is a cross sectional view showing a positive charge, single-layer type electrophotographic photoconductor as a still another embodiment of the invention.

FIG. 1 shows a negative charge, function-separated type electrophotographic photoconductor as one embodiment of the present invention. FIG. 2 shows a positive charge, function-separated type electrophotographic photoconductor as another embodiment of the invention, FIG. 3 shows a positive charge, single-layer type electrophotographic photoconductor as a further embodiment of the invention. FIG. 4 shows a negative charge, function-separated type electrophotographic photoconductor as a still further embodiment of the invention. FIG. 5 shows a positive charge, function-separated type electrophotographic photoconductor as another embodiment of the invention. FIG. 6 shows a positive charge, single-layer type electrophotographic photoconductor as a still another embodiment of the invention. In these figures, reference numeral 1 denotes an electrically conductive substrate, 2 is an undercoat layer, 3 is a charge generation layer, 4 is a charge transport layer, 5 is a surface protective layer, 6 is a function-separated type photosensitive layer, and 6A is a single-layer type photosensitive layer.

The electrically conductive substrate 1 functions as an electrode of the photoconductor, and also functions as a support for the other layers. This substrate 1 may have a cylindrical shape, planar shape, or film-like shape, and may be formed of a metal, such as aluminum, stainless steel or nickel, or glass or resin that has been treated to be given a certain conductivity.

The undercoat layer 2, which is formed from a layer containing a resin as a major component, or an oxide film such as alumite, may be provided as needed for the purposes of preventing unnecessary charges from injecting from the conductive substrate into the photosensitive layer, covering defects on the surface of the substrate, and improving the adhesiveness of the photosensitive layer, for example. A resin binder of the undercoat layer 2 may be selected from polyethylene, polypropylene, polystyrene, acrylic resin, vinyl chloride resin, polyvinyl acetate resin, polyurethane resin, epoxy resin, polyester resin, melamine resin, silicone resin, polybutyral resin, and polyamide resin, and copolymers of these resins, which may be used in suitable combination. The undercoat layer 2 may further contain fine particles of a metal oxide, such as $SiO_2$, $TiO_2$, $In_2O_3$, or $ZrO_2$.

The film thickness of the undercoat layer 2 depends on the composition of the materials used in this layer, but may be set to a desired value within a range in which the photoconductor does not suffer from adverse influences, such as an increase in the residual potential, when it is repeatedly and continuously used.

The charge generation layer 3, which serves to generate charges upon receipt of light, is formed by depositing an organic photoconductive substance on the undercoat layer 2 by vapor deposition, or coating the layer 2 with a coating liquid in which particles of an organic photoconductive substance are dispersed in a resin binder. This charge generation layer 3 is desired to generate charges with high efficiency, and also have a high ability of injecting the generated charges into the charge transport layer 4. Namely, it is desirable that the charge generation layer 3 be less dependent upon an electric field, and capable of injecting the charges into the charge transport layer 4 even in a low electric field. Since the charge generation layer 3 is only required to provide a charge generating function, the film thickness of this layer 3 is determined depending upon the light absorption coefficient of its charge generating substance. Thus, the thickness of the charge generation layer is generally controlled to be not greater 5 $\mu$m, preferably, not greater than 1 $\mu$m. The charge generation layer 3 contains a charge generating substance as a major component, to which a charge transport substance and others may be added. The charge generating substance may be selected from phthalocyanine, phthalocyanine-based pigment, such as metal-free phthalocyanine titanyl phthalocyanine and tin phthalocyanine, azo pigment, anthoanthrone pigment, perylene pigment, perynone pigment, squarilium pigment, thiapyrylium pigment, quinacridone pigment, and any combination of these pigments, for example.

The resin binder used in the charge generation layer 3 may be selected from polycarbonate resin, polyester resin, polyamide resin, polyurethane resin, epoxy resin, polyvinyl butyral resin, polyvinyl acetal resin, vinyl chloride resin, phenoxy resin, silicone resin, methacrylate resin, and copolymers of these resins, which may be used in suitable combination.

The charge transport layer 4 is a film formed by dispersing a charge transport substance in a resin binder. The thus formed charge transport layer 4 serves as an insulating layer in the dark for maintaining the surface charge of the photoconductor, and also has a function of transporting charges injected from the charge generation layer upon receipt of light.

The charge transport layer 4 contains the charge transport substance and resin binder as major components, and may further contain an orange dye compound for preventing deterioration due to exposure to light, according to the present invention. The orange dye compound used in the present embodiment may be selected from 1-o-tolylazo-2-naphthol, 5-(9-anthracenyl methylene) amino-3-methyl-1-tolylpyrazole, 4,5-diiodo-3,6-fluoranediol, and 4,5-dibromo-3,6-fluoranediol, for example.

The orange dye compound, when added to the charge transport layer, is contained in an amount of 0.01 to 10 parts by weight, preferably, 0.05 to 5 parts by weight, with respect to a total of 100 parts by weight of the charge transport substance and resin binder.

The charge transport substance used in the charge transport layer 4 may be selected from polymers capable of transporting charges, such as a hydrazone compound, styril compound, pyrazoline compound, pyrazolone compound, oxadiazole compound, arylamine compound, benzidine compound, stilbene compound, butadiene compound, and polyvinyl carbazole. The resin binder may be selected from polycarbonate resin, polyester resin, polystyrene resin, polymer and copolymer of methacrylate. It is important that the resin binder be selected in view of the compatibility with the charge transport substance, as well as the mechanical, chemical and electrical stability and adhesiveness. The film thickness of the charge transport layer 4 is preferably held in a range of 3 to 50 $\mu$m, more preferably, 10 to 40 $\mu$m, so as to maintain a practically effective surface potential.

The surface protective layer 5 may be provided as needed, and is formed of a material that has high durability against mechanical stresses, and is also chemically stable. This surface protective layer 5 has functions of receiving and maintaining charges produced by a corona discharge in the dark, and also transmitting light to which the charge generation layer is sensitive. Thus, the layer 5 is required to transmit light during exposures, to permit the light to reach the charge generation layer, and also neutralize and eliminate the surface charge when the charges generated by the charge generation layer are injected into this layer.

A material for forming the surface protective layer may be selected from polyvinyl butyral resin, polycarbonate resin, nylon resin, polyurethane resin, polyarylate resin, modified silicone resins, such as acrylic modified silicone resin, epoxy modified silicone resin, alkyd modified silicone resin, polyester modified silicone resin, and urethane modified silicone resin, and a silicone resin serving as a hard coat agent. While the above-indicated modified silicone resins may be used alone, it is preferable to use a mixture of the resin with $SiO_2$, $TiO_2$, $In_2O_3$, or $ZrO_2$ as a major component and is able to form a coating film, in order to improve the durability of the resulting surface protective layer. The surface protective layer may further contain an orange dye compound.

The orange dye compound used in the surface protective layer may be selected from 1-o-tolylazo-2-naphthol, 5-(9-anthracenyl methylene) amino-3-methyl-1-tolylpyrazole, 4,5-diiodo-3,6-fluoranediol, and 4,5-dibromo-3,6-fluoranediol, for example. The orange dye compound, when added to the surface protective layer, is contained in an amount of 0.01 to 10 parts by weight, preferably, 0.05 to 5 parts by weight, with respect to 100 parts by weight of the resin binder.

The film thickness of the surface protective layer depends on the composition of the materials used in this layer, but may be set to a desired value within a range in which the obtained photoconductor does not suffer from adverse influences, such as an increase in the residual potential, when it is repeatedly and continuously used.

The photosensitive layer 6A of the single-layer type photoconductor as shown in FIG. 3 or FIG. 6 is formed by dispersing a charge generating substance and a charge transport substance in a resin binder. Further, the above-described orange dye compound may be added to these materials, and the charge generating substance, charge transport substance and resin binder may be selected from those as listed above.

The film thickness of the photosensitive layer 6A of the single-layer type photoconductor is preferably held in a range of 3 to 50 $\mu$m, more preferably, 10 to 40 $\mu$m, so as to maintain a practically effective surface potential. The orange dye compound, when added to the photosensitive layer of the single-layer type photoconductor, is contained in an amount of 0.01 to 10 parts by weight, preferably, 0.05 to 5 parts by weight, with respect to a total of 100 parts by weight of the charge generation substance, the charge transport substance and resin binder.

The photosensitive layer of the laminated-layer type and single-layer photoconductors may further contain an antioxidant as needed, for the purpose of improving the stability against heat, ozone and others. The antioxidant used for this purpose may be selected from chromanol derivatives, such as tocopherol, and their etherified compounds or esterified compounds, polyaryl alkane compounds, hydroquinone derivatives and their monoetherified compounds or dietherified compounds, benzophenone derivatives, benzotriazole derivatives, thioether compounds, phenylene diamine derivatives, phosphorous acid ester, phenol compounds, hindered phenol compounds, straight chain amine compounds, cyclic amine compounds, and hindered amine compounds.

The photosensitive layer of the laminated-layer type and single-layer type photoconductors may further contain an electron acceptor substance as needed, for the purpose of improving the sensitivity, reducing the residual potential, or reducing variations in its characteristics during repeated use. The electron acceptor substance may be selected from compounds having a high electron affinity, such as succinic anhydride, maleic anhydride, dibromomaleic anhydride, phthalic anhydride, 3-nitrophthalic anhydride, 4-nitrophthalic anhydride, pyromellitic anhydride, pyromellitic acid, trimellitic acid, trimellitic anhydride, phthalimide, 4-nitrophthalimide, tetracyanoethylene, tetracyanoquinodimethane, chloranyl, bromanyl, and o-nitrobenzonic acid.

The orange dye compound may be added to the photosensitive layer or surface protective layer, irrespective of the layer structure of the photoconductor. Namely, the orange dye compound may be added to all of the photosensitive layer(s) and surface protective layer, or may be added to only one of these layers, to yield a satisfactory effect.

EXAMPLES

In the description of examples described below, "part" means part by weight, and "%" means percentage by weight.

First, an example of synthesis of titanyl oxyphthalocyanine will be described as Synthesis Example 1.

Synthesis Example 1

Initially, 47.5 g of titanium tetrachloride was dropped under a nitrogen atmosphere into 128 g of phthalodinitrile and 1000 g of quinoline. After dropping, the obtained liquid was heated, and its ingredients were caused to react to each other at 200° C. for 8 hours while being heated, and then cooled in the air. The resulting mixture was filtered at 130° C., washed with 500 g of quinoline heated to 130° C. and further with N-methyl-2-pyrrolidinone heated to 130° C., and then washed with methanol and water in this order. The thus obtained wet cake was dispersed in 1000 g of a 3% aqueous solution of caustic soda, heated for four hours, and then filtered and washed with water until a neutral filtrate was obtained. This cake was then dispersed in 1000 g of a 3% hydrochloric acid solution, heated for four hours, then washed with water until a neutral filtrate was obtained, and further washed with methanol and acetone. The purifying process using alkali, acid, methanol and acetone was repeated several times, and the purified substance was dried. The yield was 101.2 g.

Subsequently, 50 g of the thus obtained titanyl oxyphthalocyanine was slowly added to 750 g of a concentrated sulfuric acid solution held at −10° C. or lower, while being cooled and stirred so that the liquid temperature was kept −5° C. or lower. The resulting liquid was then stirred for two hours, and dropped into an ice water at 0° C.. After filtering a deposited blue substance and washing it with water, the obtained cake was dispersed in 500 g of 2% aqueous solution of caustic soda, then heated, washed with water after filtering, and dried. The yield of the obtained titanyl oxyphthalocyanine was 47 g.

Then, a mixture of 40 g of this titanyl oxyphthalocyanine, 100 g of sodium chloride, and 400 g of water was put into a sand mill (trade name "Dynomill" available from "Shinmaru Enterprises Corporation, Japan) filled with zirconia beads, and dispersed for three hours at room temperature, to provide fine particles. Then, 200 g of dichlorotoluene was added, and the sand mil was kept operated. The content of the sand mil was then taken out, and dichlorotoluene was distilled by means of a water vapor. Thereafter, the remaining titanyl oxyphthalocyanine was filtered with water, and then dried. The x-ray diffraction spectrum of the thus obtained titanyl oxyphthalocyanine detected by CuKα rays had apparent diffraction peaks at Bragg angles (2θ±0.2°) of 7.22°, 9.60°, 11.60°, 13.40°, 14.88°, 18.34°, 23.62°, 24.14° and 27.32°, and had the maximum diffraction peak at 9.60°.

Example 1

A photoconductor drum (30ϕ) was produced so that its electric characteristics were evaluated. Initially, an aluminum blank pipe was dipped for coating in a dispersion liquid for forming an undercoat layer, and dried at 100° C. for 30 minutes, so that an undercoat layer having a thickness of 4 μm was formed on the aluminum pipe. The dispersion liquid for the undercoat layer had a composition as follows:

| | |
|---|---|
| alcohol-soluble nylon (CM 8000 available from Toray Industries, Inc., Japan) | 5 parts |
| fine particles of titanium oxide subjected to amino silane finishing | 5 parts |
| mixed solvent of methanol and methylene chloride with the weight ratio 6/4 | 90 parts |

Then, the aluminum pipe coated with the undercoat layer was dipped for coating in a dispersion liquid for forming a charge generation layer, and dried at 100° C. for 30 minutes, so that a charge generation layer having a thickness of 0.3 μm was formed on the undercoat layer. The dispersion liquid for the charge generation layer had a composition as follows:

| | |
|---|---|
| titanyl oxyphthalocyanine (Synthesis Example 1) | 1 part |
| copolymer resin containing vinyl chloride (MR 110 available from Nippon Zeon Co., Ltd., Japan) | 1 part |
| methylene chloride | 98 parts |

The aluminum pipe coated with the charge generation layer was then dipped for coating in a solution for forming a charge transport layer, which used o-methyl-p-dibenzylamino benzaldehyde-(diphenyl hydrazone) as a charge transport substance, and dried at 100° C. for 30 minutes, so that a charge transport layer having a thickness of 20 μm was formed on the charge generation layer. The solution for the charge transport layer had a composition as follows:

| | |
|---|---|
| hydrazone compound as indicated above | 10 parts |
| 1-o-tolylazo-2-naphthol (Orange No. 403 available from Kishi Chemical Industries, Co., Ltd., Japan) | 0.05 parts |
| polycarbonate resin (K1300 available from Teijin Chemicals, Ltd., Japan) | 10 parts |
| methylene chloride | 90 parts |

In the above manner, an electrophotographic photoconductor was produced.

Example 2

A photoconductor was produced in the same manner as in Example 1, except that the content of 1-o-tolylazo-2-naphthol was changed to 0.5 parts.

Comparative Example 1

A photoconductor was produced in the same manner as in Example 1, except that 1-o-tolylazo-2-naphthol used in Example 1 was not added.

Comparative Example 2

A photoconductor was produced in the same manner as in Example 1, except that 1-o-tolylazo-2-naphthol used in Example 1 was replaced by 0.05 parts of 2-(2-quinolyl)-1,3-indandinone (Yellow No. 204 available from Kishi Chemical Industries, Co., Japan) that is a yellow dye compound.

Comparative Example 3

A photoconductor was produced in the same manner as in Example 1, except that 1-o-tolylazo-2-naphthol used in Example 1 was replaced by 0.5 parts of 2-(2-quinolyl)-1,3-indandinone (Yellow No. 204 available from Kishi Chemical Industries, Co., Ltd.) that is a yellow dye compound.

Example 3

A photoconductor was produced in the same manner as in Example 1, except that 1-o-tolylazo-2-naphthol used in Example 1 was not added into a coating liquid for the charge transport layer, and a surface protective layer having a thickness of 1 μm was formed on the charge transport layer by dipping the aluminum pipe with the charge transport layer in a solution for forming the surface protective layer, and drying it at 100° C. for 30 minutes. The solution for forming the surface protective layer had a composition as follows:

| | |
|---|---|
| 1-o-tolylazo-2-naphthol (Orange No. 403 available from Kishi Chemical Industries Co., Ltd.) | 0.05 parts |
| polyvinyl butyral resin (S-LEC BM-2 available from Sekisui Kagaku Kogyo Kabushiki Kaisha) | 10 parts |
| tetrahydrofuran | 90 parts |

Example 4

A photoconductor was produced in the same manner as in Example 3, except that the content of 1-o-tolylazo-2-naphthol was changed to 0.5 parts.

Comparative Example 4

A photoconductor was produced in the same manner as in Example 3, except that 1-o-tolylazo-2-naphthol was not added.

Comparative Example 5

A photoconductor was produced in the same manner as in Example 3, except that 1-o-tolylazo-2-naphthol used in Example 3 was replaced by 0.05 parts of 2-(2-quinolyl)-1,3-indandinone (Yellow No. 204 available from Kishi Chemical Industries Co., Ltd.) that is a yellow dye compound.

Comparative Example 6

A photoconductor was produced in the same manner as in Example 3, except that 1-o-tolylazo-2-naphthol used in Example 3 was replaced by 0.5 parts of 2-(2-quinolyl)-1,3-indandinone (Yellow No. 204 available from Kishi Chemical Industries Co., Ltd.) that is a yellow dye compound.

Example 5

A photoconductor was produced in the same manner as in Example 1, except that 1-o-tolylazo-2-naphthol used in Example 1 was replaced by 5-(9-anthracenyl methylene) amino-3-methyl-1-tolylpyrazole.

Example 6

A photoconductor was produced in the same manner as in Example 1, except that 1-o-tolylazo-2-naphthol used in Example 1 was replaced by 4,5-diiodo-3,6-fluoranediol.

Example 7

A photoconductor was produced in the same manner as in Example 1, except that 1-o-tolylazo-2-naphthol used in Example 1 was replaced by 4,5-dibromo-3,6-fluoranediol.

Example 8

A photoconductor was produced in the same manner as in Example 3, except that 1-o-tolylazo-2-naphthol used in Example 3 was replaced by 5-(9-anthracenyl methylene) amino-3-methyl-1-tolylpyrazole.

Example 9

A photoconductor was produced in the same manner as in Example 3, except that 1-o-tolylazo-2-naphthol used in Example 3 was replaced by 4,5-diiodo-3,6-fluoranediol.

Example 10

A photoconductor was produced in the same manner as in Example 3, except that 1-o-tolylazo-2-naphthol used in Example 3 was replaced by 4,5-dibromo-3,6-fluoranediol.

The electric characteristics of the photoconductor drum of each example were measured using an electric characteristic evaluation apparatus. In this test, the surface of the photoconductor was charged by a corona discharge of corotron type in the dark until the charging voltage $V_O$ became equal to about −650V, and the potential $V_O$ of the charged surface was measured. Then, the corona discharge was stopped, and the surface potential $V_D$ was measured after the photoconductor drum was left in the dark for 5 seconds, to obtain the potential retention percentage $V_{K5}$ (%)

$$\text{Potential retention percentage } V_{K5}(\%)=[(V_O-V_D)/V_O]\times 100$$

Similarly, the surface of the photoconductor was charged so that Vo became equal to about −650V, and the photoconductor was kept irradiated with light having a wavelength of 780 nm and an intensity of 1 $\mu$W/cm$^2$, so as to measure the amount of exposure $E_{100}$ required to attenuate the potential from −600V to −100V. Also, the residual potential $V_{R5}$ was measured 5 seconds after irradiation.

To evaluate light fatigue characteristics, the photoconductor was left under a fluorescent lamp of 1500 lux-seconds for 10 minutes, and the potential was measured before and after the exposure, using the apparatus for evaluating electric characteristics of photoconductor drums. In the test, the photoconductor drum was charged while it was being rotated so that the charging voltage $V_O$ became equal to about −600V, and the potential of the charged surface $V_O$ was measured. Then, the photoconductor was irradiated with light having a wavelength of 780 nm and an intensity of 2 $\mu$W/cm$^2$ for 0.25 seconds, and the potential $V_L$ of the illuminated portion was measured.

TABLE 1A-1B indicates the electric characteristics of the photoconductors obtained in Examples 1–10 and Comparative Examples 1–6. In this table, "Before" and "After" respectively means "before exposure" and "after exposure".

TABLE 1-A

| | Initial Characteristics | | | |
|---|---|---|---|---|
| Specimen | $V_O$ (−V) | $E_{100}$ ($\mu$J/cm$^2$) | $V_{K5}$ (%) | $V_{R5}$ (−V) |
| Example 1 | 651 | 0.63 | 96.8 | 19 |
| Example 2 | 650 | 0.64 | 96.8 | 21 |
| Example 3 | 653 | 0.69 | 97.4 | 23 |
| Example 4 | 652 | 0.70 | 97.5 | 25 |
| Example 5 | 649 | 0.64 | 96.5 | 18 |
| Example 6 | 651 | 0.66 | 96.8 | 20 |
| Example 7 | 648 | 0.66 | 96.7 | 21 |
| Example 8 | 651 | 0.68 | 97.3 | 25 |
| Example 9 | 653 | 0.71 | 97.6 | 28 |
| Example 10 | 653 | 0.70 | 97.6 | 27 |
| Comparative Example 1 | 650 | 0.62 | 96.5 | 18 |
| Comparative Example 2 | 651 | 0.68 | 95.3 | 28 |
| Comparative Example 3 | 649 | 1.06 | 91.4 | 57 |
| Comparative Example 4 | 653 | 0.69 | 97.3 | 22 |
| Comparative Example 5 | 650 | 0.74 | 96.6 | 38 |
| Comparative Example 6 | 650 | 0.81 | 95.2 | 51 |

TABLE 1-B

| | Light Fatigue Characteristics | | | | | |
|---|---|---|---|---|---|---|
| | Potential Vo (−V) of Charged Surface | | | Potential $V_L$ (−V) of Illuminated portion | | |
| | Before | After | Variation | Before | After | Variation |
| Example 1 | 595 | 585 | −10 | 120 | 115 | −5 |
| Example 2 | 595 | 580 | −15 | 130 | 120 | −10 |
| Example 3 | 600 | 595 | −5 | 140 | 140 | 0 |
| Example 4 | 600 | 590 | −10 | 145 | 135 | −10 |
| Example 5 | 595 | 590 | −5 | 125 | 120 | −5 |
| Example 6 | 600 | 590 | −10 | 120 | 110 | −10 |
| Example 7 | 600 | 585 | −15 | 125 | 115 | −10 |
| Example 8 | 605 | 595 | −8 | 145 | 135 | −10 |
| Example 9 | 605 | 600 | −5 | 140 | 135 | −5 |
| Example 10 | 605 | 600 | −5 | 140 | 125 | −15 |
| Comparative Example 1 | 595 | 640 | +45 | 115 | 340 | +225 |
| Comparative Example 2 | 590 | 625 | +35 | 145 | 335 | +190 |
| Comparative Example 3 | 590 | 610 | +20 | 185 | 300 | +115 |

TABLE 1-B-continued

| | Light Fatigue Characteristics | | | | | |
|---|---|---|---|---|---|---|
| | Potential Vo (−V) of Charged Surface | | | Potential $V_L$ (−V) of Illuminated portion | | |
| | Before | After | Variation | Before | After | Variation |
| Comparative Example 4 | 600 | 655 | +55 | 135 | 415 | +280 |
| Comparative Example 5 | 600 | 645 | +45 | 165 | 395 | +230 |
| Comparative Example 6 | 595 | 625 | +30 | 195 | 380 | +185 |

As is understood from Table 1, the photoconductor to which the orange dye compound is added according to the present invention is free from fatigue due to exposure to light, and the addition of the orange dye compound does not deteriorate electrophotographic characteristics, such as the sensitivity and residual potential, of the obtained photoconductor. It is thus apparent that the photoconductor using the orange dye compound for the purpose of reducing fatigue due to light is superior to known photoconductors using no orange dye compound or other dye compound.

According to the present invention, the photosensitive layer or surface protective layer contains an orange dye compound, and therefore serves to absorb or block blue light through ultraviolet light having strong chemical activities. The resulting electrophotographic photoconductor is free from fatigue due to exposure to light, while assuring excellent electrophotographic characteristics, such as the sensitivity or residual potential.

The photoconductor containing the orange dye compound may be applied to various kinds of machines, such as those of non-contact charging type, such as corotron or scrotron, or those of contact charging type equipped with rollers or brushes, and those of one magnetic component, one non-magnetic component, or two-component development type. In particular, a remarkable effect can be obtained according to the invention when it is applied to copying machine and printers using light for removing the surface potential.

What is claimed is:

1. An electrophotographic photoconductor comprising:

an electrically conductive substrate;

a charge generation layer formed on said electrically conductive substrate; and a charge transport layer formed on said charge generation layer;

wherein said charge transport layer contains an orange dye compound; and wherein said orange dye compound is selected from the group consisting of 1-o-tolylazo-2-naphthol, 5-(9-anthracenyl methylene) amino-3-methyl-1-tolylpyrazole, 4,5-diiodo-3,6-fluoranediol, and 4,5-dibromo-3,6-fluoranediol.

2. An electrophotographic photoconductor, comprising:

an electrically conductive substrate; and a photosensitive layer formed on said electrically conductive substrate;

wherein said photosensitive layer contains an orange dye compound; and wherein said orange dye compound is selected from the group consisting of 1-o-tolylazo-2-naphthol, 5-(9-anthracenyl methylene) amino-3-methyl-1-tolylpyrazole, 4,5-diiodo-3,6-fluoranediol, and 4,5-dibromo-3,6-fluoranediol.

3. An electrophotographic photoconductor, comprising:

an electrically conductive substrate;

a photosensitive layer formed on said electrically conductive substrate; and a surface protective layer;

wherein said surface protective layer contains an orange dye compound; and wherein said orange dye compound is selected from the group consisting of 1-o-tolylazo-2-naphthol, 5-(9-anthracenyl methylene) amino-3-methyl-1-tolylpyrazole, 4,5-diiodo-3,6-fluoranediol, and 4,5-dibromo-3,6-fluoranediol.

* * * * *